US010336127B1

(12) United States Patent
Suhling

(10) Patent No.: US 10,336,127 B1
(45) Date of Patent: Jul. 2, 2019

(54) EZ SPEEDY DUAL CLIP

(71) Applicant: Robert James Suhling, Waukegan, IL (US)

(72) Inventor: Robert James Suhling, Waukegan, IL (US)

( * ) Notice: Subject to any disclaimer, the term of this patent is extended or adjusted under 35 U.S.C. 154(b) by 0 days.

(21) Appl. No.: 16/015,541

(22) Filed: Jun. 22, 2018

(51) Int. Cl.
*B42F 9/00* (2006.01)

(52) U.S. Cl.
CPC ..... *B42F 9/001* (2013.01)

(58) Field of Classification Search
CPC ..... B42F 9/001; B42F 1/006; B42F 9/008
USPC ..... 248/447.1, 457, 458, 343, 490
See application file for complete search history.

(56) References Cited

U.S. PATENT DOCUMENTS 2,876,022 A * 3/1959 Kroviak ..... B42F 9/001 108/43
3,083,427 A * 4/1963 Grenon ..... G03D 15/08 24/343
4,157,152 A * 6/1979 Blastic ..... A63B 57/00 224/247
4,375,137 A * 3/1983 Chitwood ..... A01K 97/06 224/920
5,184,375 A * 2/1993 Hoyt ..... A47B 97/02 224/247
6,971,616 B1 * 12/2005 Lake ..... B42F 9/001 24/67.3
2010/0139050 A1 * 6/2010 Kelly ..... B42F 9/001 24/67.5
2011/0259690 A1 * 10/2011 Clayton ..... B42F 9/002 190/109

* cited by examiner

*Primary Examiner* — Steven M Marsh
(74) *Attorney, Agent, or Firm* — Lesley A. Wallerstein, LLC

(57) ABSTRACT

An EZ SPEEDY DUAL CLIP that increases the functionality of clipboards. The invention consists of a display surface, two clips, and some bends in the display surface. The clips are mounted on opposite faces and ends of the display surface, allowing both sides of the invention to be utilized. There are bends on both ends of the invention which allow the it to be positioned in various different ways for hands-free viewing. The invention can be inserted into most gaps and tracks, and it can also hook onto and hang from most surfaces and protrusions. When inserted into a gap or track, it is rigid enough to be written on.

2 Claims, 17 Drawing Sheets

EZ SPEEDY DUAL CLIP

FIELD OF THE INVENTION

The present invention relates generally to clipboards, and more specifically, it relates to a metal clipboard that is able to insert into most tracks and gaps or hang onto most ledges to become a hands-free support for increased visibility and productivity.

DESCRIPTION OF THE PRIOR ART

There are many different clipboards being produced in the market. Typically, they are a flat surface made out of either plastic, wood, or metal, and have a clip fastened in the center of the surface's short edge. The user can lift the clip to insert objects and release the clip to secure the objects to the clipboard.

The main problem with said prior art is realized when the objects are already inserted into the clipboard and the user wants to reference the objects while they work. The clipboard can only exist either flat on whatever surface the user has available, or it has to be held by the user. This reduces either the visibility or the productivity of the user.

SUMMARY OF THE INVENTION

A primary object of the present invention is to provide a clipboard that will overcome the shortcomings of the prior art devices. Another object is to provide a clipboard that is rigid and durable for lasting everyday use. Another object is to provide a clipboard that can insert into most gaps and tracks. Another object is to provide a clipboard that can hook onto and hang from most ledges. Another object is to provide a clipboard that can clip objects well enough to hold them securely in any orientation of the clipboard.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

REFERENCE NUMERALS

Figure 1:
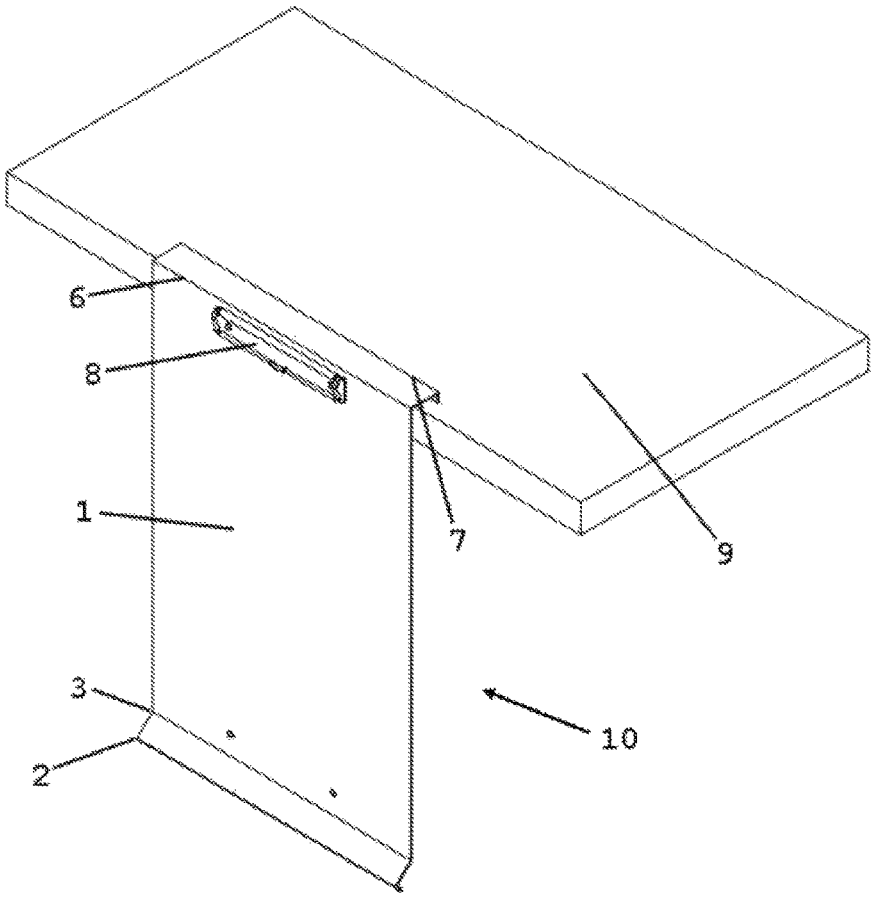
FIG. 1 is an upper perspective view of the present invention hanging on a ledge.

1 Display surface
2 Mount angle
3 Display angle
4 Front clip
5 Track
6 First hook angle
7 Second hook angle
8 Back clip
9 Ledge
10 Dual clip clipboard

DESCRIPTION OF THE PREFERRED EMBODIMENT

Figure 2:
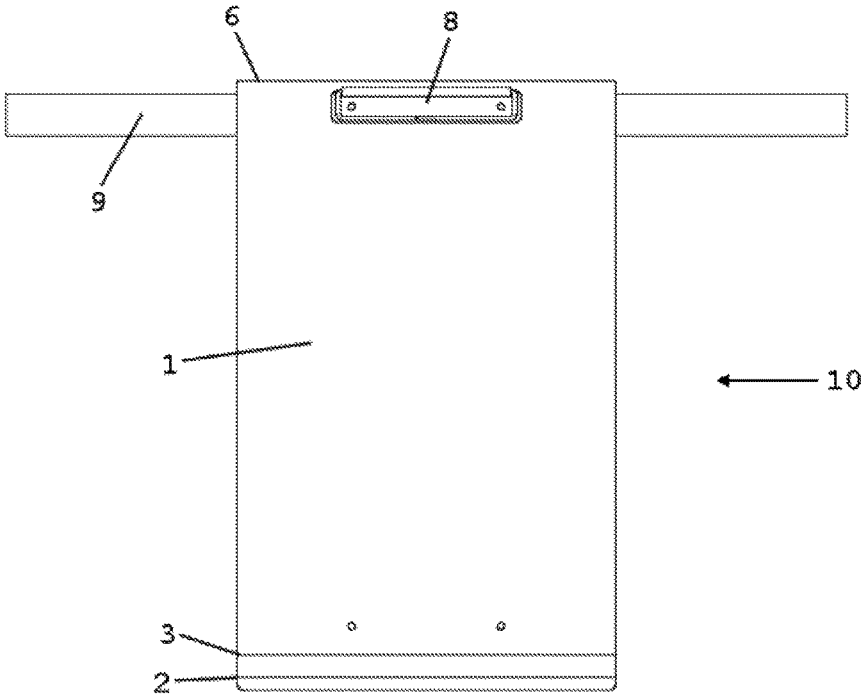
FIG. 2 is a front view of the present invention hanging on a ledge.
Figure 3:
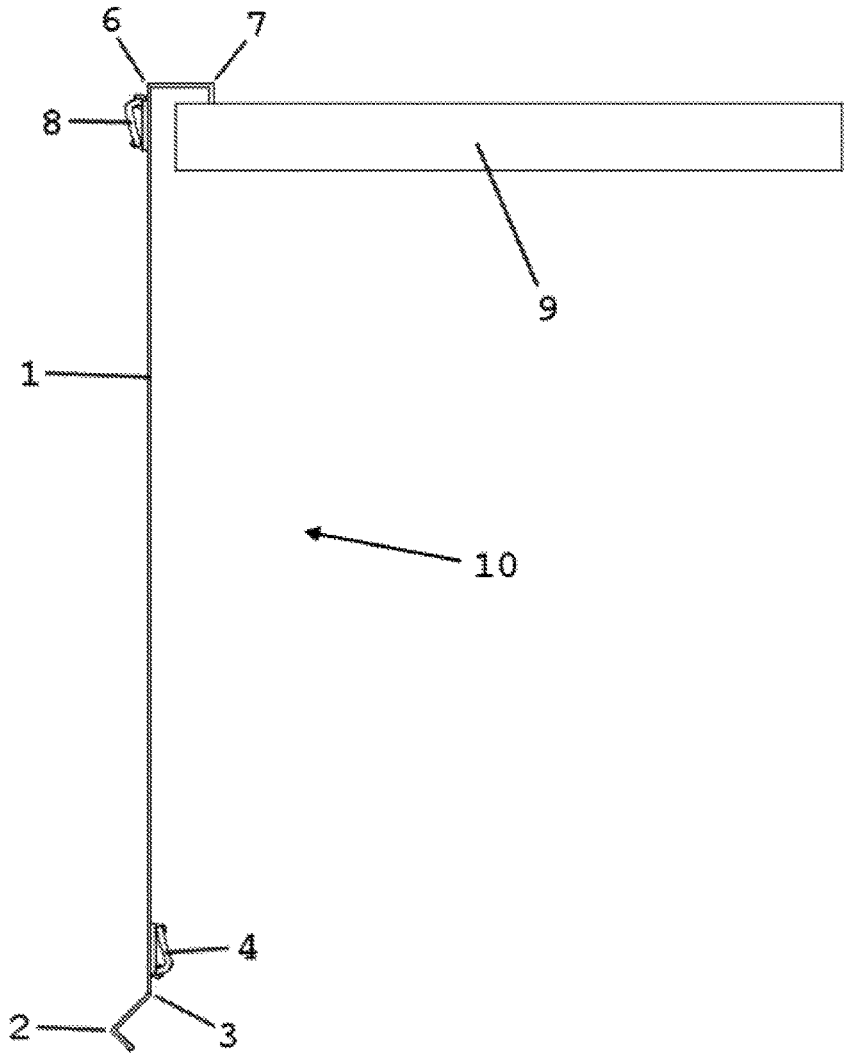
FIG. 3 is a side view of the present invention hanging on a ledge.
Figure 4:
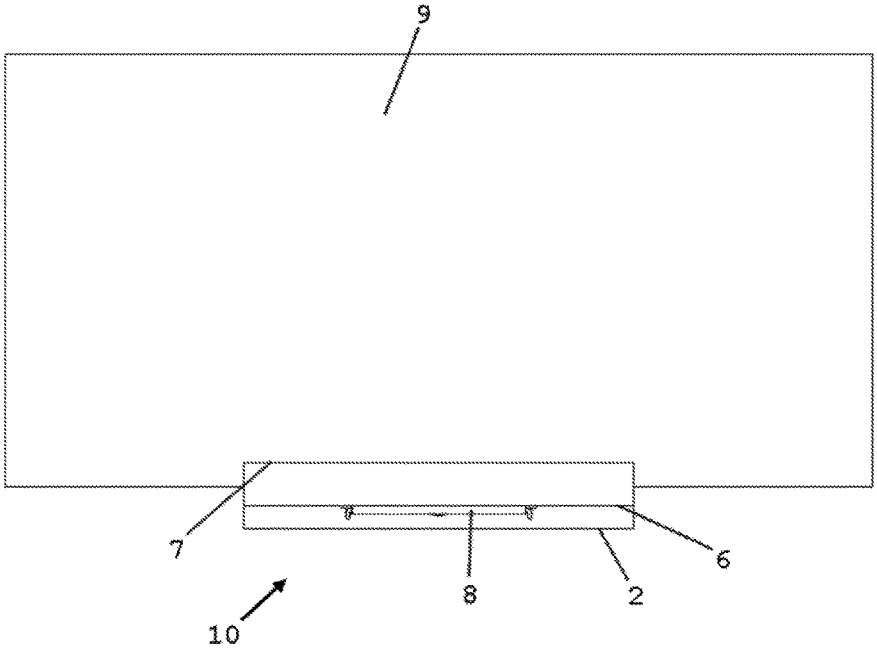
FIG. 4 is a top view of the present invention hanging on a ledge.

FIGS. 1 through 4 illustrate a dual clip clipboard 10 hanging from surface 9. The preferred embodiment of the present invention consists of a rectangular display surface 1, a front clip 4, and a back clip 8. Display surface 1 comprises a front face, a back face, a top edge and a bottom edge. There are four bend lines in the display surface 1 which are designed to allow insertion or hanging on most tracks, gaps, and ledges.

These four bend lines comprise two spaced-apart top bend lines parallel to the top edge of the front face and two spaced-apart bottom bend lines parallel to the bottom edge. The top bend line further from the top edge is bent away from the front face at an obtuse angle, forming display angle 3. The top bend line nearer to the top edge is bent toward the front face at a right angle, forming mount angle 2. The bottom bend line further from the bottom edge is bent toward the front face at a right angle, forming first hook angle 6; the bottom bend line nearer to the bottom edge is bent toward the front face at a right angle, forming second hook angle 7. The first hook angle 6 and the second hook angle 7 allow the dual clip clipboard 10 to hang from ledge 9 without any other equipment.

The front clip 4 is mounted to the front face below the display angle and opens toward the bottom of the front face. Back clip 8 is mounted to the back face above the first hook angle and opens toward the top of the front face. That is, the two clips are mounted to display surface 1 on opposite faces and edges from each other, with each clip opening toward each other.

Figure 5:
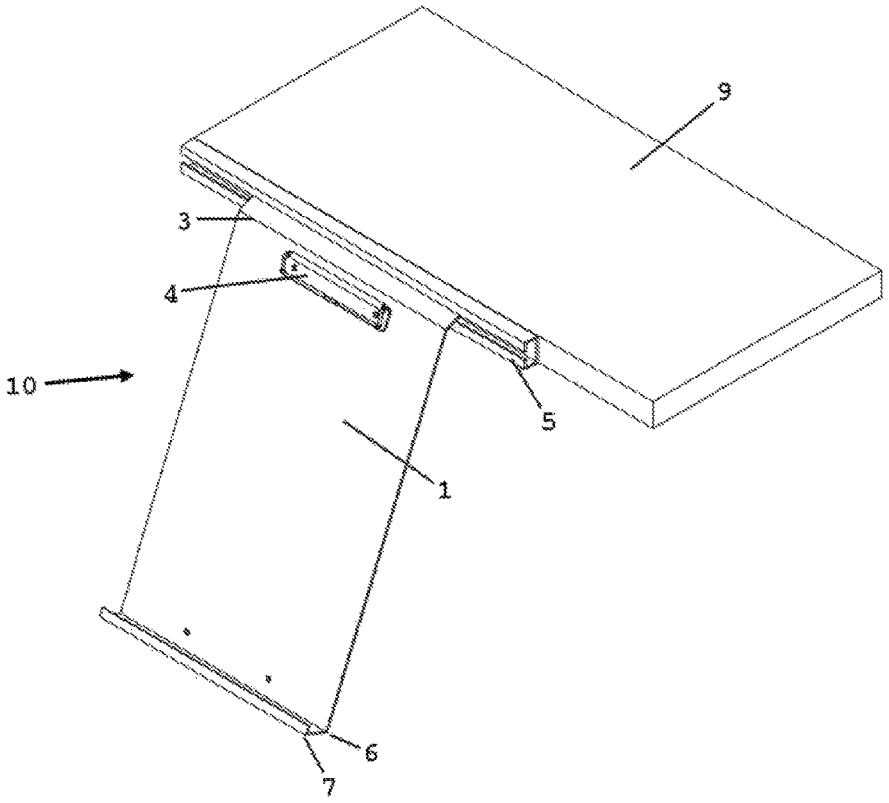
FIG. 5 is an upper perspective view of the present invention inserted into a horizontal track on the side of a ledge.
Figure 6:
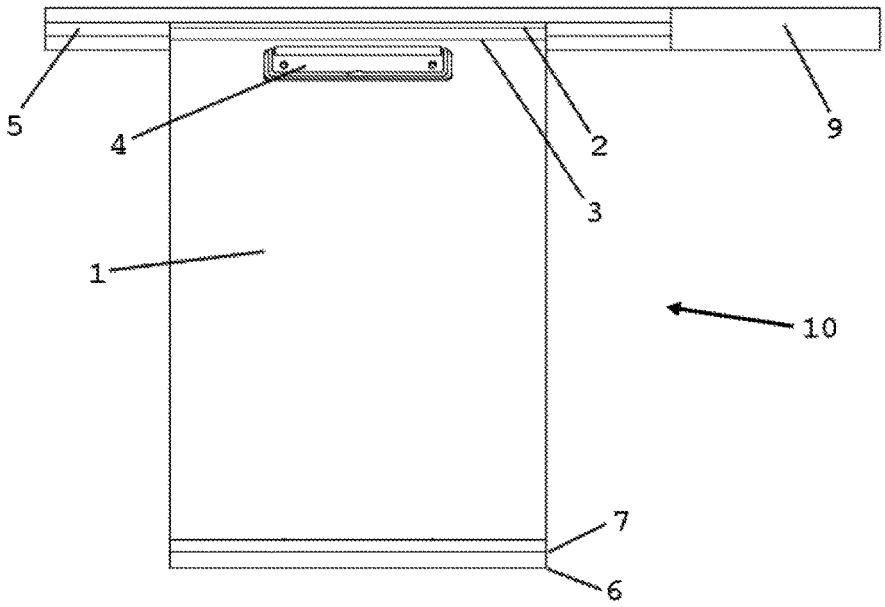
FIG. 6 is a front view of the present invention inserted into a horizontal track on the side of a ledge.
Figure 7:
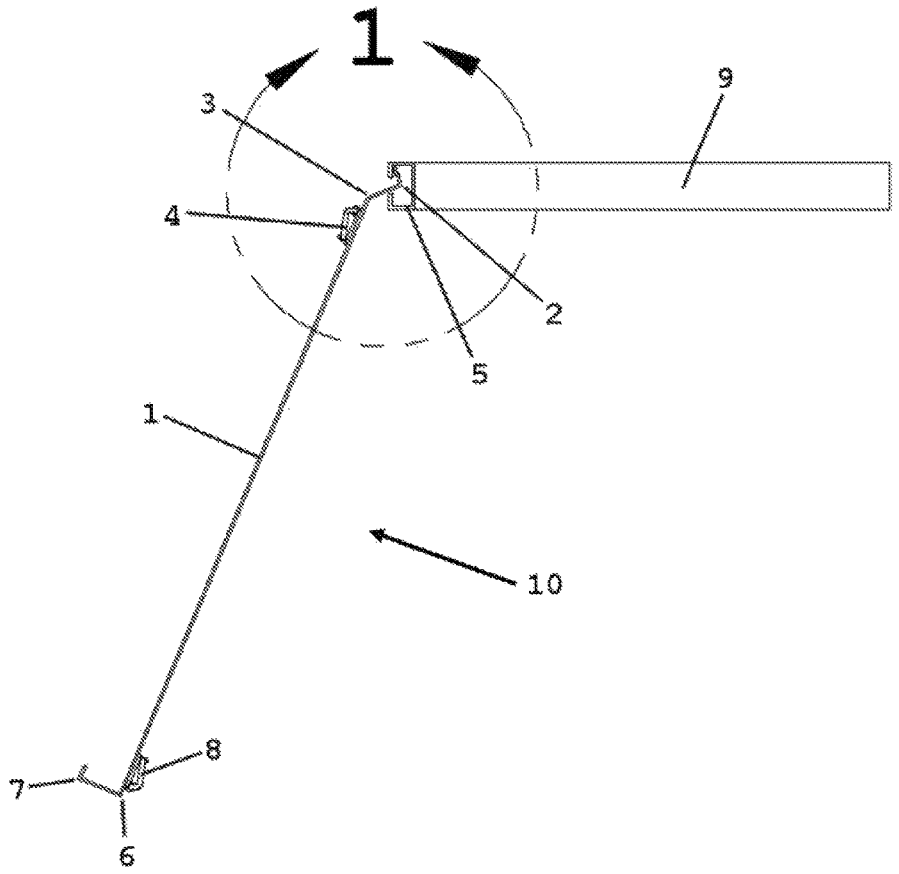
FIG. 7 is a side view of the present invention inserted into a horizontal track on the side of the ledge.
Figure 8:
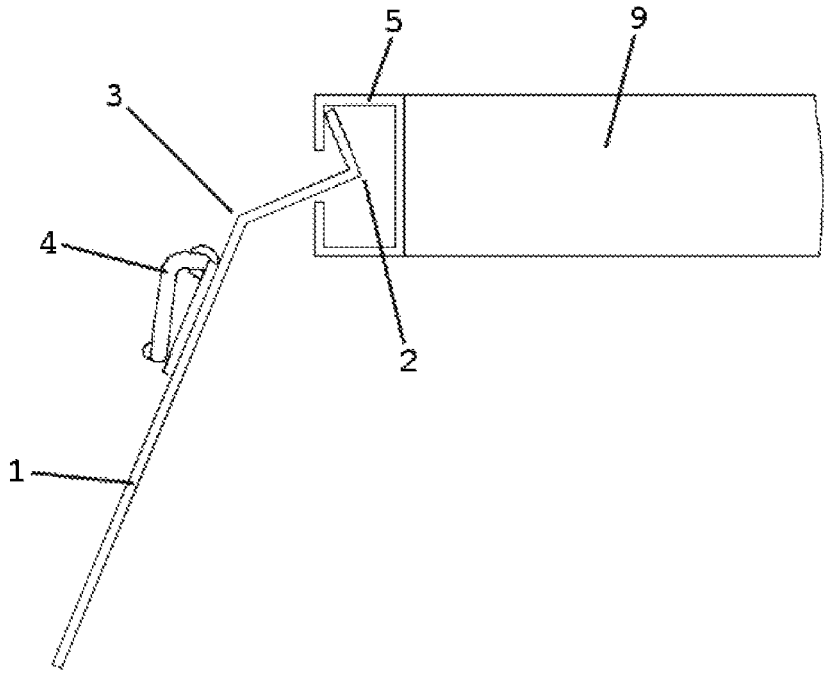
FIG. 8 is a magnified side view taken from circle 1 of FIG. 7.
Figure 9:
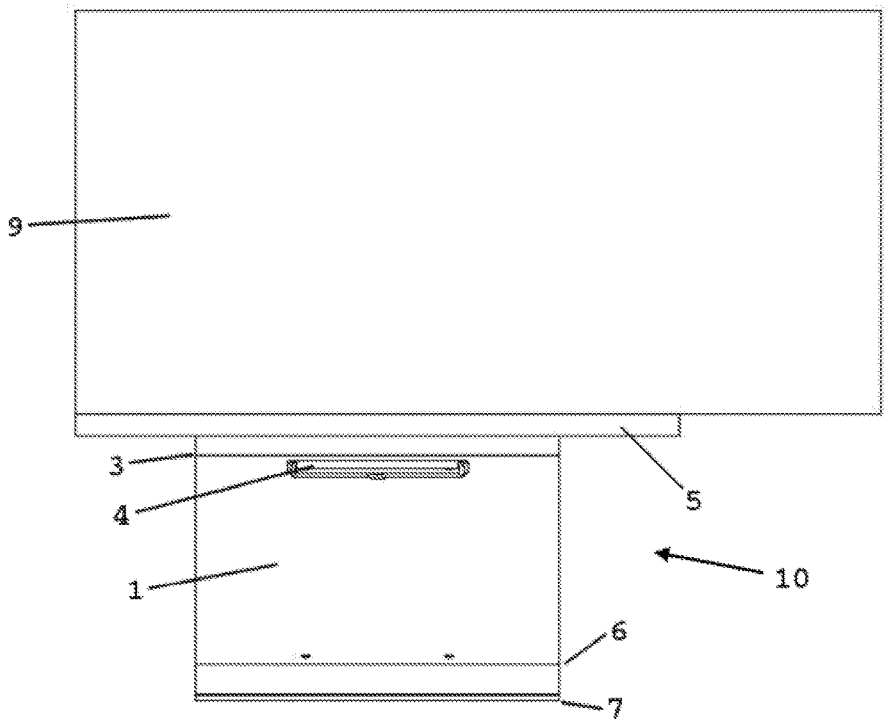
FIG. 9 is a top view of the present invention inserted into a horizontal track on the side of a ledge.

FIGS. 5 through 9 illustrate a dual clip clipboard 10 inserted into a track 5 that is mounted horizontally on the side of ledge 9. The bends of the mount angle 2 and display angle 3 allow the unique position of the dual clip clipboard 10. The mount angle 2 wedges inside the track 5 in a way that allows the display surface to protrude out from the track 5. The display angle 3 changes the angle at which the display surface 1 extends from the track 5 for a more pleasant view of the dual clip clipboard 10. This orientation also allows first hook angle 6 and second hook angle 7 to act as a shelf for small objects such as a writing device.

Figure 10:
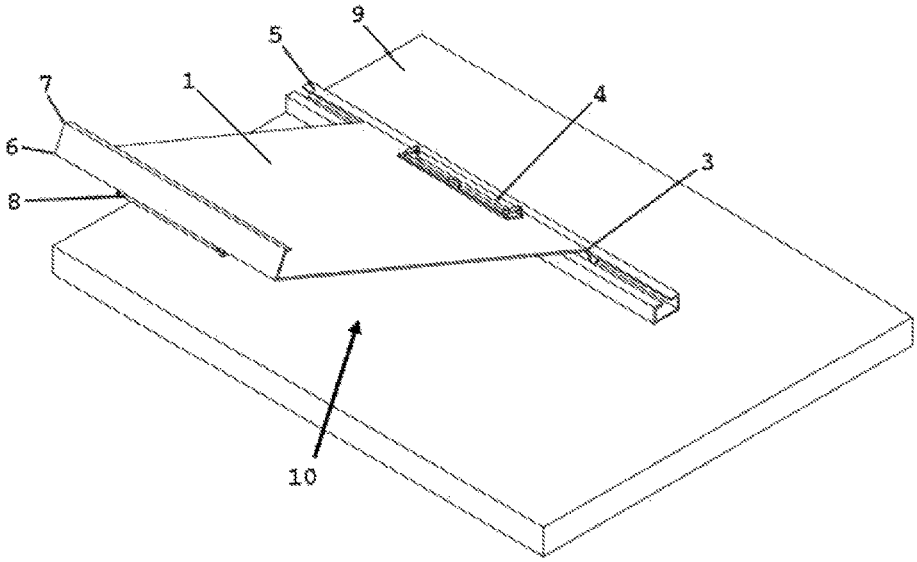
FIG. 10 is an upper perspective view of the present invention inserted into a horizontal track on top of a ledge.
Figure 11:
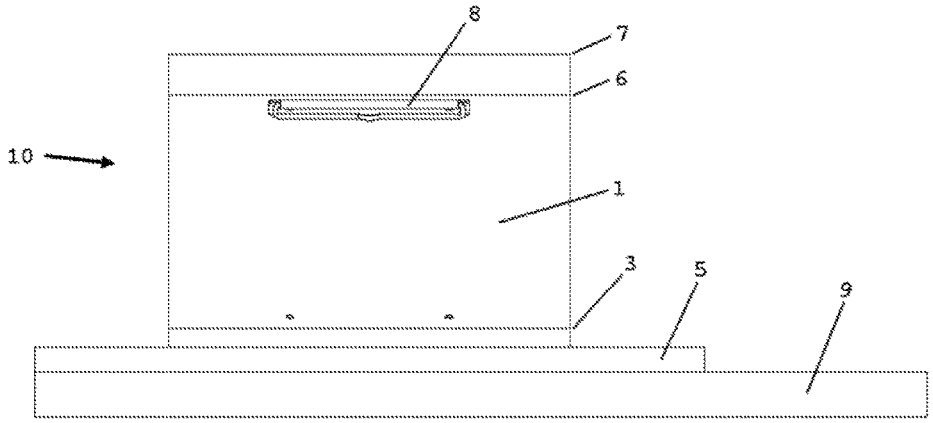
FIG. 11 is a front view of the present invention inserted into a horizontal track on top of a ledge.
Figure 12:
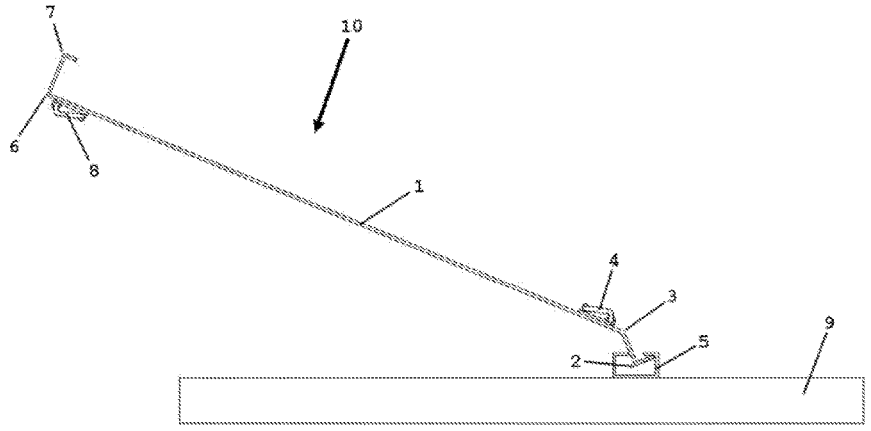
FIG. 12 is a side view of the present invention inserted into a horizontal track on top of a ledge.
Figure 13:
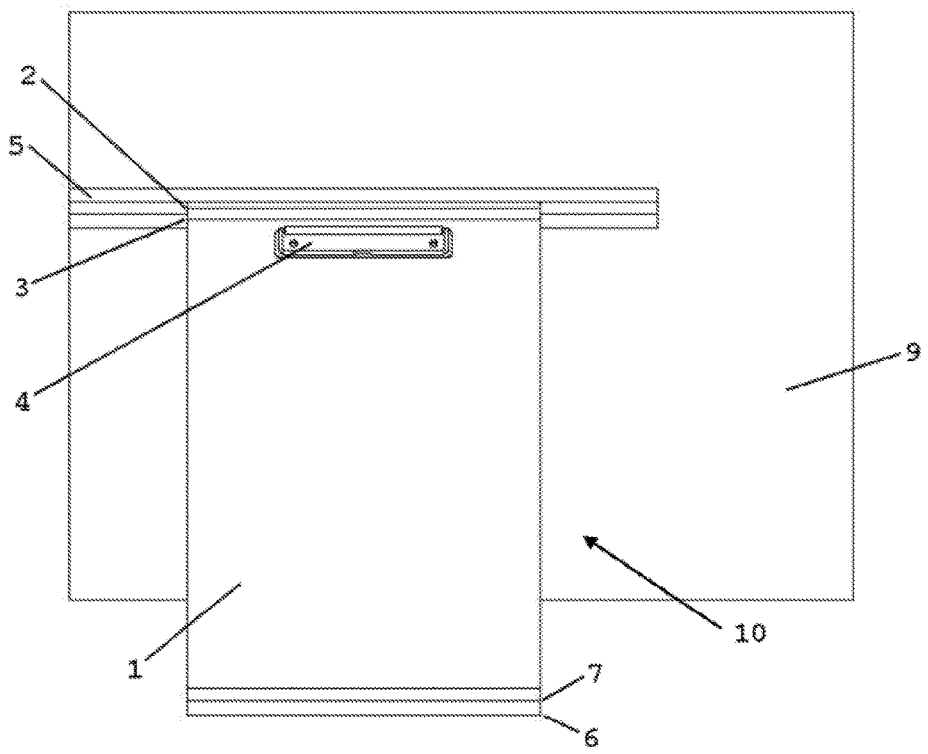
FIG. 13 is a top view of the present invention inserted into a horizontal track on top of a ledge.

FIGS. 10 through 13 illustrate a dual clip clipboard 10 inserted into a track 5 that is mounted horizontally on top of a surface 9. These figures show how useful the display angle 3 is for the ease of viewing any objects on the dual clip clipboard 10 while working off of a horizontal ledge 9.

Figure 14:
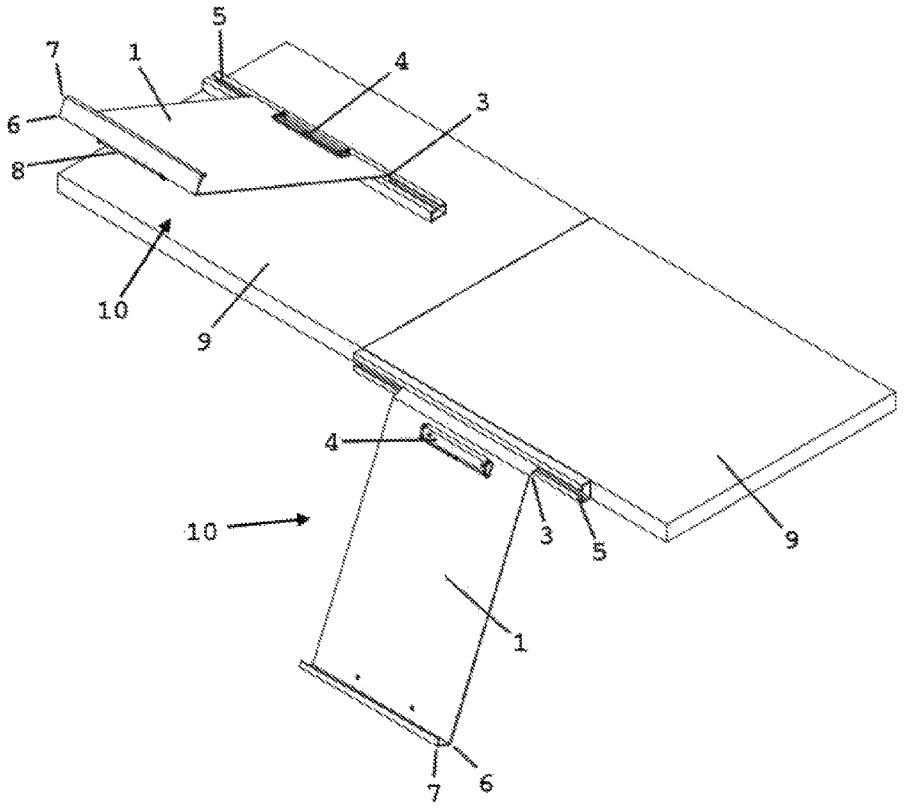
FIG. 14 is an upper perspective view of two present inventions inserted into two different horizontal tracks.
Figure 15:
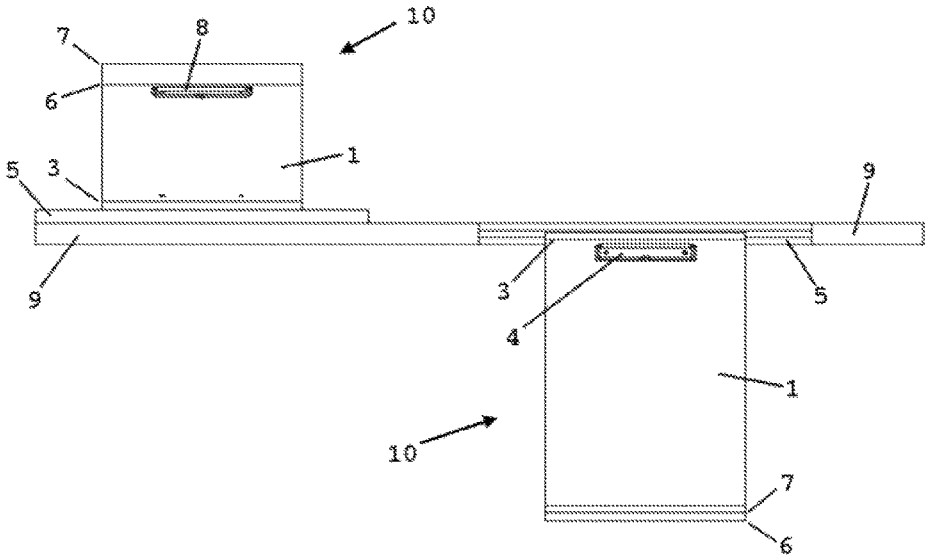
FIG. 15 is a front view of two present inventions inserted into two different horizontal tracks.
Figure 16:
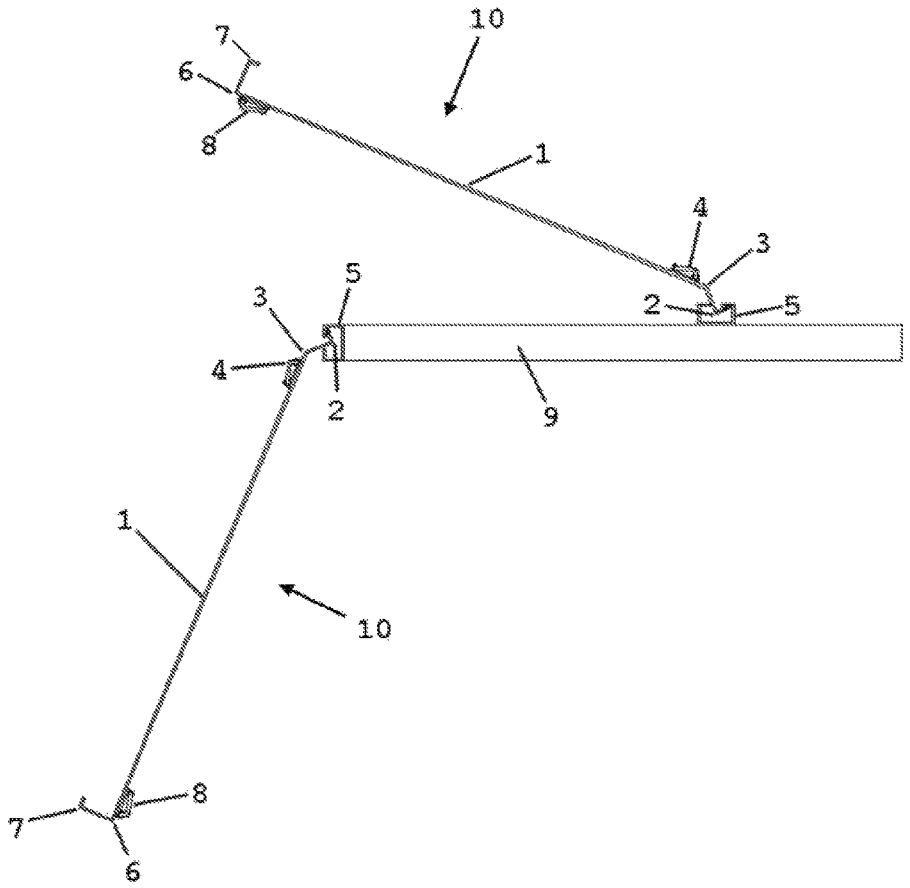
FIG. 16 is a side view of two present inventions inserted into two different horizontal tracks.
Figure 17:
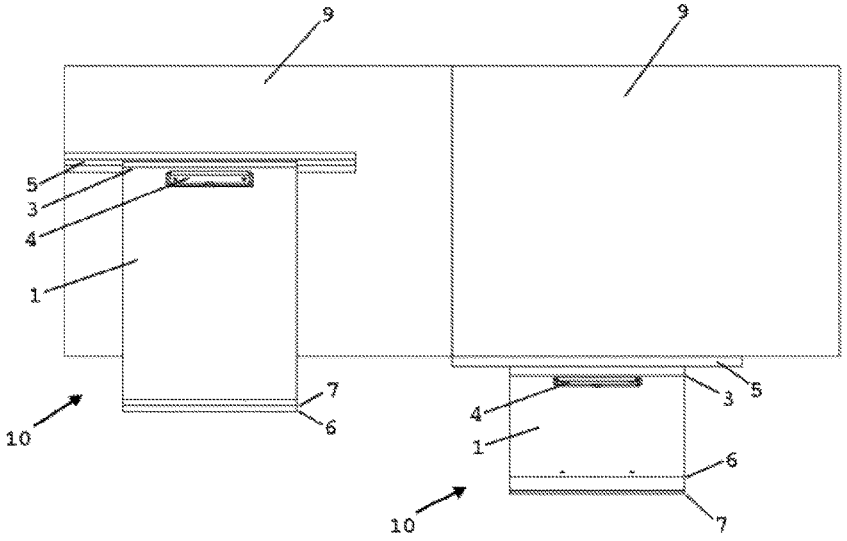
FIG. 17 is a top view of two present inventions inserted into two different horizontal tracks.

FIGS. 14 through 17 illustrate two dual clip clipboards 10 inserted into two different tracks 5 for two different viewing angles. In use, the user would insert an object that needs displaying into either the front clip 4 or back clip 8 and take the dual clip clipboard 10 to their workstation. If there is a gap or track of some sort, the user would put the object in frontclip 4 and insert the side with mount angle 2 and display angle 3 into the gap or track. Sometimes first hook angle 6 and second hook angle 7 work better for specific gaps and tracks. This makes dual clip clipboard 10 protrude from the gap or track, and the user now has a rigid, hands-free viewing and writing surface. The user can also use first hook angle 6 and second hook angle 7 in conjunction to act as a hook when temporarily affixing the dual clip clipboard 10 to most ledges 9. Another feature of the dual clip clipboard 10 is that the user can use both frontclip 4 and back clip 8 at the same time. There can be different objects placed in both clips so that there is a quick and easy transition from viewing one object to the other. The user does not need to unclip anything when switching between two different objects to view.

I claim:

1. A hands-free, self-supporting, reversible clipboard, comprising a rigid, rectangular display surface having a front face and a back face, the front face further comprising:

a top edge, two spaced-apart top bend lines parallel to the top edge, wherein the top bend line further from the top edge is bent away from the front face at an obtuse angle, forming a display angle, and the top bend line nearer to the top edge is bent toward the front face at a right angle, forming a mount angle, and;

a bottom edge, two spaced-apart bottom bend lines parallel to the bottom edge, wherein the bottom bend line further from the bottom edge is bent toward the front face at a right angle, forming a first hook angle, and the bottom bend line nearer to the bottom edge is bent toward the front face at a right angle, forming a second hook angle;

a front clip mounted to the front face below the display angle and opening toward the bottom of the front face;

a back clip mounted to the back face above the first hook angle and opening toward the top of the front face.

2. The hands-free, self-supporting, reversible clipboard of claim 1, wherein the display surface is made from metal.

* * * * *